US011781195B2

(12) United States Patent
Chung et al.

(10) Patent No.: US 11,781,195 B2
(45) Date of Patent: Oct. 10, 2023

(54) HIGH-STRENGTH STEELS FOR THE FORMATION OF WEAR-PROTECTIVE LUBRICIOUS TRIBOFILMS DIRECTLY FROM HYDROCARBON FLUIDS

(71) Applicant: Northwestern University, Evanston, IL (US)

(72) Inventors: Yip-Wah Chung, Wilmette, IL (US); Qian Wang, Mt. Prospect, IL (US); Arman Mohammad Khan, Evanston, IL (US); Tobias Vela Martin, Evanston, IL (US)

(73) Assignee: Northwestern University, Evanston, IL (US)

( * ) Notice: Subject to any disclaimer, the term of this patent is extended or adjusted under 35 U.S.C. 154(b) by 15 days.

(21) Appl. No.: 17/550,951

(22) Filed: Dec. 14, 2021

(65) Prior Publication Data

US 2022/0195549 A1 Jun. 23, 2022

Related U.S. Application Data

(60) Provisional application No. 63/126,636, filed on Dec. 17, 2020.

(51) Int. Cl.
*C23C 18/00* (2006.01)
*C21D 8/02* (2006.01)
(Continued)

(52) U.S. Cl.
CPC ..... *C21D 8/0278* (2013.01); *C21D 1/58* (2013.01); *C21D 1/60* (2013.01); *C21D 1/613* (2013.01); *C21D 8/0205* (2013.01); *C22C 38/22* (2013.01); *C22C 38/24* (2013.01); *C23C 18/1204* (2013.01); *C23C 18/1241* (2013.01); *C21D 2201/00* (2013.01); *C21D 2211/001* (2013.01)

(58) Field of Classification Search
CPC ..... C23C 18/1204; C23C 18/1241
See application file for complete search history.

(56) References Cited

U.S. PATENT DOCUMENTS

2008/0145264 A1* 6/2008 Hetzner ..... C21D 5/00 148/612
2018/0216408 A1* 8/2018 Bomidi ..... E21B 10/24

FOREIGN PATENT DOCUMENTS

WO WO-2019014223 A1 * 1/2019 ..... B01J 23/755

OTHER PUBLICATIONS

Rounds, Fred G. "Influence of steel composition on additive performance." *Asle Transactions* (1972), vol. 15, No. 1; pp. 54-66. DOI: 10.1080/05698197208981403.

(Continued)

*Primary Examiner* — Hai Y Zhang
(74) *Attorney, Agent, or Firm* — BELL & MANNING, LLC

(57) ABSTRACT

Methods for forming carbon-based lubricious and/or wear-protective films in situ on the surface of steel alloys are provided. The methods use chromium-containing steel alloys, molybdenum-containing steel alloys, and steel alloys that contain both copper and nickel. When such alloys are subjected to a rubbing motion in the presence of a hydrocarbon fluid, the chromium, molybdenum, copper, and nickel in the steel alloy catalyzes the formation of solid carbon-containing films that reduce the friction, wear, or both of the contacting surfaces.

21 Claims, 16 Drawing Sheets

(51) Int. Cl.

| | |
|---|---|
| ***C22C 38/22*** | (2006.01) |
| ***C22C 38/24*** | (2006.01) |
| ***C21D 1/58*** | (2006.01) |
| ***C21D 1/60*** | (2006.01) |
| ***C21D 1/613*** | (2006.01) |
| ***C23C 18/12*** | (2006.01) |

(56) References Cited

OTHER PUBLICATIONS

Hall, J. M. "Wear and friction studies of neopentyl polyol ester lubricants." *Asle Transactions* (1969), vol. 12, No. 4; pp. 242-253. DOI: 10.1080/05698196908972268.

R. Benda et al., "Synthetics Basics: Polyalphaolefins—Base Fluids for High-Performance Lubricants," JSL 13-1; pp. 41-57.

R.S. Owens et al., "The Use of Unsaturated Hydrocarbons as Boundary Lubricants for Stainless Steels," *Asle Transactions* (1967), vol. 10. No. 1; pp. 77-84. DOI: 10.1080/05698196708972167.

Konstantinos Pagkalis, "Influence of steel composition on the formation and effectiveness of lubricant boundary layers in tribological contacts," a Thesis submitted to Imperial College London in fulfilment of the degree of Doctor of Philosophy and the Diploma of Imperial College. Dec. 2017.

B. Cacre et al., "The Effect of Metal Composition on the Adsorption of Zinc Di-Isopropyldithiophosphate," *Asle Transactions* (1983), vol. 26, No. 3; pp. 333-343. DOI: 10.1080/05698198308981511.

Khashayar Khanlari et al., "Reciprocating Sliding Wear Behavior of 60NiTi as Compared to 440C Steel under Lubricated and Unlubricated Conditions," *Tribology Transactions* (2018), vol. 61, No. 6; pp. 991-1002. DOI: 10.1080/10402004.2018.1460434.

Devlin, Mark, et al., "Effect of Metallurgy on the Formation of Tribofilms and Wear Prevention," No. 2017-01-2357. *SAE Technical Paper*, Oct. 8, 2017; pp. 1-7.

Blake Johnson et al., "Direct Formation of Lubricious and Wear-Protective Carbon Films from Phosphorus-and Sulfur-Free Oil-Soluble Additives," *Tribology Letters* (2018), vol. 66, No. 2; pp. 1-13. https://doi.org/10.1007/s11249-017-0945-2.

Ali Erdemir et al., "Carbon-based tribofilms from lubricating oils," *Nature* Aug. 4, 2016, vol. 536; pp. 67-71.

Wu, Hongxing, et al. "Formation and Nature of Carbon-Containing Tribofilms." *ACS applied materials & interfaces* (2019), vol. 11; pp. 16139-16146.

Makoto Miyajima et al., "Technical Report: Characterization of Tribochemical Reactions on Steel Surfaces," *Nippon Steel & Sumitomo Metal Technical Report* 114 Mar. 2017: pp. 101-107.

Joe Hodkiewicz et al., "Characterizing Carbon Materials with Raman Spectroscopy," *Thermo Scientific*, Application Note: 51901; pp. 1-5.

H.W. Hermance et al., Organic Deposits on Precious Metal Contacts, *The Bell System Technical Journal*, May 1958; pp. 739-776.

Arman Mohammad Khan, "Tribological Interface Improvement through Lubricant Additive Innovation, Surface and Material Modification," a Dissertation submitted to Northwestern University Graduate School in Partial Fulfillment of the Requirements for the degree Doctor of Philosophy—Filed of Mechanical Engineering, Jun. 2021; pp. 1-24.

Konstantinos Pagkalis, "The Influence of Steel Composition on the Formation and Effectiveness of Anti-wear Films in Tribological Contacts," *Tribology Letters* (2021); vol. 69; pp. 1-20. https//doi.org/10.1007/s11249-021-01438-6.

William R. Jones, Jr. et al., "Evaluation of Several Space Lubricants Using a Vacuum Four-Ball Tribometer," NASA STI Program Office, Oct. 1998; pp. 1-18.

J. William Miller, "Applications Review—Synthetic Lubricants and their Industrial Applications," JSL (1); pp. 136-152.

Yonggang Meng et al., "A review of recent advances in tribology," *Friction* 2020, vol. 8, Issue 2, Article 15; pp. 221-300.

* cited by examiner

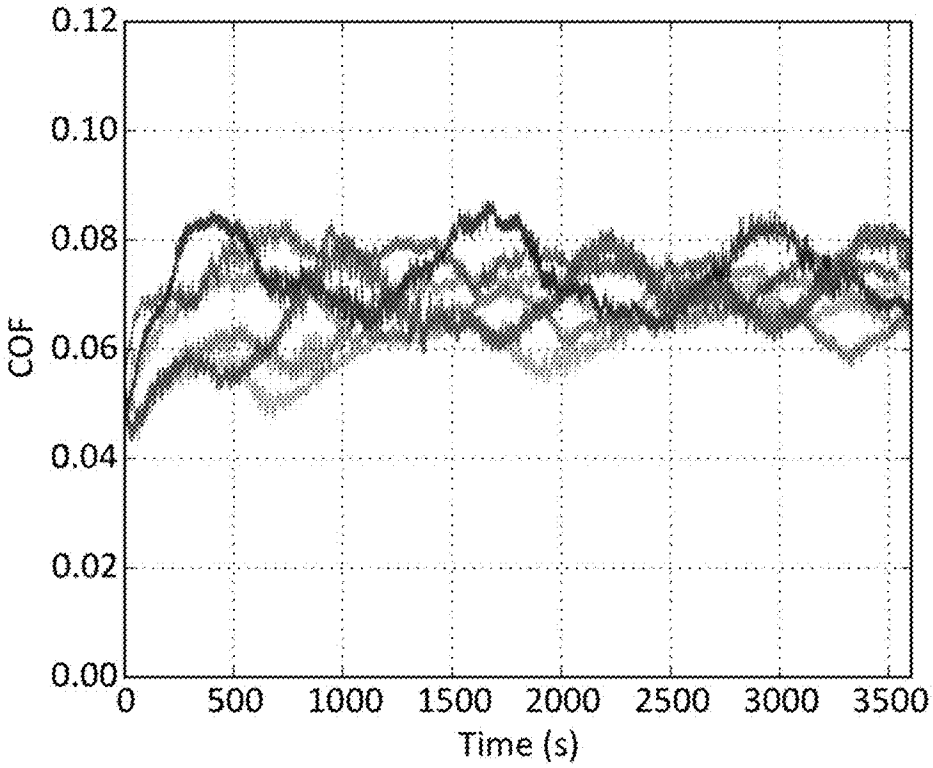
FIG. 7A
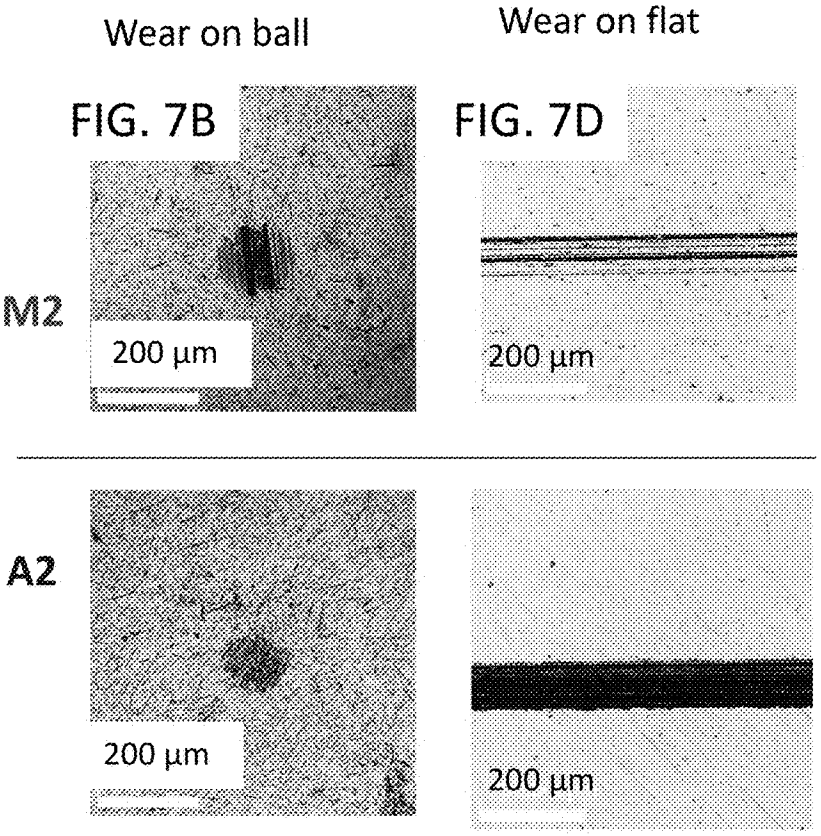

HIGH-STRENGTH STEELS FOR THE FORMATION OF WEAR-PROTECTIVE LUBRICIOUS TRIBOFILMS DIRECTLY FROM HYDROCARBON FLUIDS

CROSS-REFERENCE TO RELATED APPLICATIONS

This application claims priority to U.S. provisional patent application No. 63/126,636 that was filed on Dec. 17, 2020, the entire contents of which are incorporated herein by reference.

REFERENCE TO GOVERNMENT RIGHTS

This invention was made with government support under W911NF202029 awarded by the U.S. Army Research Laboratory. The government has certain rights in the invention.

BACKGROUND

Carbon-containing films are widely used in engineering systems to reduce friction and wear. In some cases, these films, which may be characterized as graphitic, diamond-like carbon (DLC), or polymeric, are deposited by chemical or physical vapor deposition methods. In other cases, these films are formed in situ. Such films have been observed to form in sliding metal contacts lubricated by hydrocarbons. (See, Hermance, H. W., and T. F. Egan. "Organic deposits on precious metal contacts." Bell System Technical Journal 37.3 (1958): 739-776.)

SUMMARY

Methods for forming carbon-based lubricating films in situ on the surface of substrates of steel alloys that are in sliding or rolling contact are provided. The substrates are characterized in that they have a significant concentration of chromium, molybdenum, copper, nickel or combinations thereof.

One example of a method includes the steps of: providing a first steel substrate, wherein the first steel substrate is a high-carbon steel having a chromium content of at least 5 weight percent, a high-carbon steel having a molybdenum content of at least 4 weight percent; or a low-carbon steel having a copper content of at least 1 weight percent and a nickel content of at least 1 weight percent or a combined copper and nickel content of at least 1 weight percent; applying a coating comprising a hydrocarbon fluid onto a surface of the first steel substrate; and sliding the hydrocarbon fluid-coated substrate surface against, or rolling the hydrocarbon fluid-coated substrate over, a second steel substrate, wherein the chromium, molybdenum, copper, or nickel in the first steel substrate catalyzes the formation of a solid carbon-containing tribofilm from the hydrocarbon fluid.

BRIEF DESCRIPTION OF THE DRAWINGS

Illustrative embodiments of the invention will hereafter be described with reference to the accompanying drawings.

FIG. 3B is an image of a 52100 steel ball surface after sliding against a 1045 steel substrate; FIG. 3C is an image of the ball surface after sliding against a D2 steel substrate; FIG. 3D shows the 1045 surface after the friction test; FIG. 3E shows the D2 surface after the friction test.

FIG. 4C shows a Raman spectrum of a diamond-like-carbon (DLC) film.

FIG. 5B is an image of a 52100 steel ball surface after sliding against an A2 steel substrate; FIG. 5C is an image of the ball surface after sliding against a D2 steel substrate; FIG. 5D shows the A2 surface after the friction test; FIG. 5E shows the D2 surface after the friction test.

FIG. 6C shows a Raman spectrum of a DLC film.

FIG. 7A is a friction comparison of M2 steel and A2 steel; FIG. 7B is an image of a 52100 steel ball surface after sliding against a M2 steel substrate; FIG. 7C is an image of the ball surface after sliding against an A2 steel substrate; FIG. 7D shows the M2 surface after the friction test; FIG. 7E shows the A2 surface after the friction test.

FIG. 8C shows a Raman spectrum of a diamond-like-carbon (DLC) film.

DETAILED DESCRIPTION

Figure 1B:
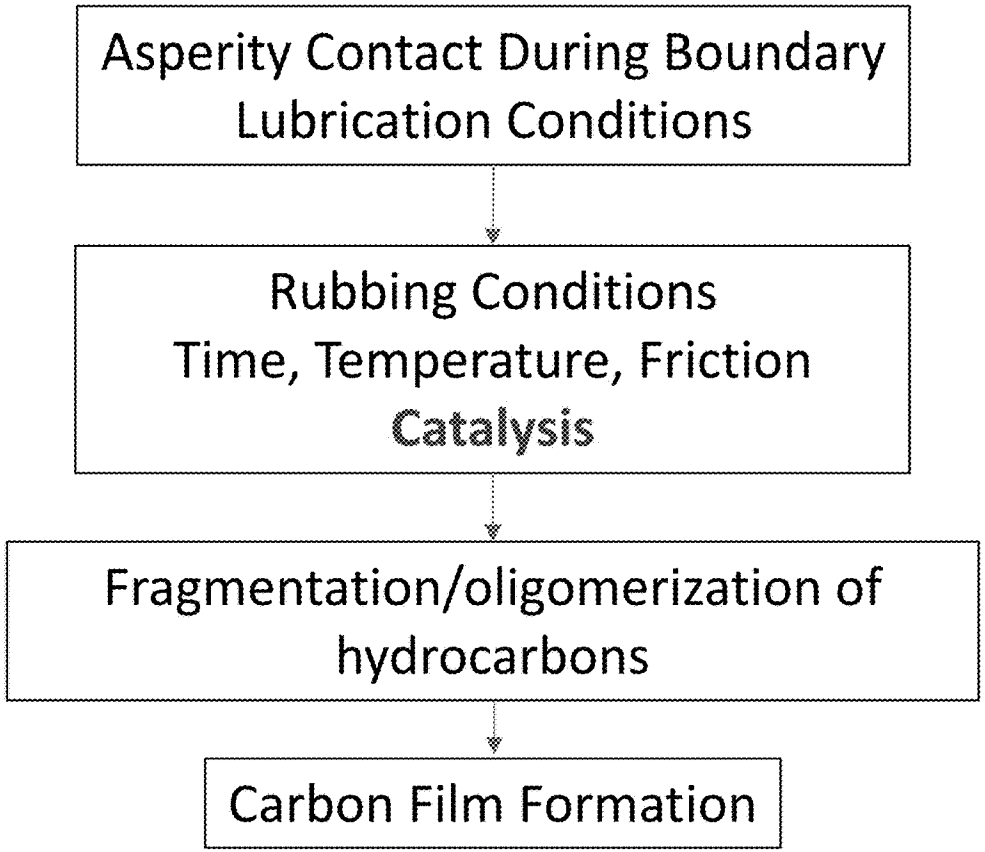
FIG. 1B is a flow chart showing the steps of tribofilm formation between two steel surfaces coated with a hydrocarbon fluid.

Methods for forming carbon-based lubricating films in situ on the surfaces of steel alloys are provided. The methods use chromium-containing steel alloys, molybdenum-containing steel alloys, or steel alloys that contain both copper and nickel. When the surface of these alloys slides across or rolls over another substrate under boundary friction conditions in the presence of a hydrocarbon fluid, the chromium, molybdenum, copper and/or nickel in the steel alloy catalyzes the formation of a solid carbon-containing film that reduces the friction and/or enhances the wear-resistance of the surfaces.

The steel alloys are mechanically strong and are referred to herein as dual-functional steels because they are able to provide mechanical strength comparable to steel alloys having lower chromium or molybdenum or copper and nickel contents and, at the same time, can produce wear-protective, lubricious carbon-containing tribofilms from hydrocarbon fluids with which they are in contact. Such steels can enhance energy efficiency due to lower friction and/or increase the lifetime of mechanical components due to lower wear. As a result, the dual-functional steels can replace other, lower chromium, molybdenum or copper and nickel content steels, such as 52100 steel, 1045 steel, or 8620 steel, that are conventionally used in tribological applications.

The steel alloys and methods described herein can be used to improve the performance of steel parts that are subjected to sliding and/or rolling operations. The types of steel alloys used in the methods described herein have not previously been identified as useful in applications that involve sliding or rolling surfaces. However, the inventors have discovered that the chromium, molybdenum, copper, and nickel in these steels are able to catalyze the in situ formation of a tribofilm between sliding and/or rolling surfaces that are made from these steels and coated with a hydrocarbon fluid. Moreover, these alloying element-catalyzed tribofilms can be formed even in the absence of antiwear and/or extreme pressure additives that are used in conventional lubricating coatings. The enhanced lubricity provided by the films formed by the catalysis more than compensates for other properties of these steels that previously discouraged their use in sliding and rolling applications in the art. Thus, the inventors' discovery has opened up new uses for these steels.

The chromium-containing steel alloys used in the sliding and/or rolling applications have a chromium content of at least 5 wt. %. This includes embodiments of the steels having a chromium content of at least 8 wt. % and further includes steels having a chromium content of at least 10 wt. %. By way of illustration only, steel alloys having a chromium content in the range from 5 wt. % to 30 wt. %, including those having a chromium content in the range from 10 wt. % to 20 wt. %, and those having a chromium content in the range from 8 wt. % to 15 wt. %, can be used. Commercially available steels that have a sufficiently high chromium content include D2 steel and A2 steel. The nominal compositions of a D2 steel and an A2 steel are shown in Table 1.

TABLE 1

Nominal Steel Compositions for Various Steels

| | Weight % concentration | | | | | | | |
|---|---|---|---|---|---|---|---|---|
| Steel Type | Cr | Mo | Cu | V | Mn | Ni | C | Fe |
| 52100 | 1.3-1.6 | — | — | — | 0.25-0.45 | — | 0.98-1.1 | Balance |
| 1045 | — | — | — | — | 0.6-0.9 | — | 0.4-0.5 | Balance |
| M2 | 3.75-4.5 | 4.5-5.5 | — | 1.75-2.2 | 0.15-0.4 | — | 0.8-1.05 | Balance |
| CF2 | — | — | 2.48 | — | 0.52 | 2.58 | 0.06 | Balance |
| D2 | 11-12.1 | 0.5-0.7 | — | 0.1-0.5 | 0.3 | — | 1.5 | Balance |
| A2 | 5 | 1 | — | 0.15-0.5 | 1 | 0.3 | 1 | Balance |

D2 and A2 steels are high-carbon, air hardening tool steels. High-carbon steels have a carbon content of more than 0.6 wt. % -typically in the range from 0.61 wt. % to 1.5 wt. %. In contrast, medium-carbon steels have a carbon content in the range from 0.30 wt. % to 0.60 wt. % and low-carbon steels have a carbon content lower than 0.30 wt. %. High-carbon steels are stronger than stainless steels, but their high carbon contents provide these steels with a low corrosion resistance when exposed to moisture. Furthermore, as carbon content increases, the ductility and toughness of the high-carbon steels tends to decrease. Chromium is added to high-carbon steels, such as D2 and A2 in order to enhance the corrosion resistance, but chromium also tends to decrease hardness. High-carbon steels are traditionally used in applications where hardness is valued, but high toughness and corrosion resistance is not important. Conventional applications for high-carbon steels are cutting tools, dies, punches, and other machining tool parts, springs, and high-strength wires.

Furthermore, in sliding and rolling applications that utilize oils as a base lubricant on steel surfaces, the industry-adopted approach is to add antiwear and/or extreme pressure additives, such as zinc-containing and zinc-free phosphates, including polyphosphates, to the base oil. The role of these additives is to react with the sliding or rolling surfaces to form a lubricious tribofilm. The presence of these additives has, therefore, generally been considered necessary in order to prevent surface damage. However, the use of these additive-containing base oils on high chromium content steels is not favorable because a higher chromium content has been shown to prevent the additives from reacting with the surfaces. (See, for example, Rounds, Fred G. "Influence of steel composition on additive performance." ASLE TRANSACTIONS 15.1 (1972): 54-66; and Hall, J. M. "Wear and friction studies of neopentyl polyol ester lubricants." ASLE TRANSACTIONS 12.4 (1969): 242-253.)

These art-recognized drawbacks of high-chromium content steels likely contributed to the failure of the industry to adopt such steels for a wider range of uses. In contrast, 52100 steel, which is a high-carbon steel with a low chromium content (less than 2 wt. %), has become a ubiquitous and long-established go-to steel in the industry for applications such as rolling bearings, and other applications, including gears and cams, where toughness and inherent and/or additive-enhanced, lubricity are important. For comparison, the nominal composition of 52100 steel, as well as the medium-carbon steel 1045, are provided in Table 1.

Steels having a substantial molybdenum content benefit from the inventors' discovery that molybdenum is able to catalyze the formation of a tribofilm from a hydrocarbon, even in the absence of antiwear and/or extreme pressure additives. The molybdenum-containing steel alloys used in sliding and/or rolling applications have a molybdenum content of at least 4 wt. %. By way of further illustration, steel alloys having a molybdenum content in the range from 4 wt.

% to 10 wt. %, including those having a molybdenum content in the range from 4 wt. % to 5 wt. % can be used. Commercially available steels that have a sufficiently high molybdenum content include M2 steel, the nominal composition of which is shown in Table 1. Notably, these steels can be used even in relatively low temperature (for example, T<300° C.) sliding and/or rolling applications and/or applications other than bearings.

Alternatively, steels having a lower content of molybdenum can be used. Such steels include steels having a molybdenum content in the range from 0.2 wt. % to 2 wt. %. In these lower molybdenum-content steels, it may be desirable to use a steel that includes one or more of the other catalytic elements of chromium, copper, and/or nickel at a concentration of at least 0.3 weight percent.

Steels containing substantial concentrations of copper and nickel benefit from the inventors' discovery that both copper and nickel are able to catalyze the formation of a tribofilm from a hydrocarbon, even in the absence of antiwear and/or extreme pressure additives.

The copper and nickel-containing steel alloys used in the sliding and/or rolling applications have a copper content of at least 1 wt. % and a nickel content of at least 1 wt. %, and may be low-carbon steels having a carbon content of 0.3 wt. % or lower, or even stainless steels having a carbon content of no greater than about 0.08 wt. %. Various embodiments of the of the copper and nickel-containing steel alloys have a copper content of at least 2 wt. % and/or a nickel content of at least 2 wt. %. By way of illustration, steel alloys having a copper content and/or nickel content in the range from 1 wt. % to 5 wt. %, including those having a copper content and/or nickel content in the range from 2 wt. % to 3 wt. %, can be used. Commercially available steels that have sufficiently high copper and nickel contents include CF2 steel. The nominal composition of a CF2 steel is shown in Table 1.

Notably, copper in steel is generally considered a nuisance element because it causes metallurgical problems. It is commonly present in steels as a contaminant introduced during the recycling of scrap metal from such sources a copper wires and motors in automobiles and appliances. (See, Daehn, Katrin E., Andre Cabrera Serrenho, and Julian M. Allwood. "How will copper contamination constrain future global steel recycling?," *Environmental science technology* 51.11 (2017): 6599-6606.) When nickel is also present in the steel, it can offset some of the problems introduced by copper by enhancing steel strength. However, steels with significant copper concentrations have found limited use, likely due to the copper nuisance problem. The inventors' discovery of the tribofilm formation-catalyzing properties of both copper and nickel opens the use of these types of steels to a broad range of new applications for which these steels had not been previously considered.

The performance improvements of the hydrocarbon-coated chromium-, molybdenum-, and copper and nickel-containing steels can be attributed to a reduction in the coefficient of friction between two steel surfaces, and/or to an improvement in wear resistance. Examples of steel components that can be made from the chromium-, molybdenum-, and/or copper and nickel-containing steels, and that benefit from tribofilm formation in the present of a hydrocarbon fluid, include components conventionally made from engineering steels that undergo sliding and/or rolling contact under a load. These components include transmission parts and engine parts. Such components include bearing parts (e.g., rolling bearings), pumps (e.g., hydraulic or fuel pumps) parts, valve parts, cams and tappets, shafts, gears, and propellers. In some embodiments of the methods described herein, the components made from the chromium-, molybdenum-, or copper and nickel-containing steel alloy are not a part of a bearing.

Figure 1A:
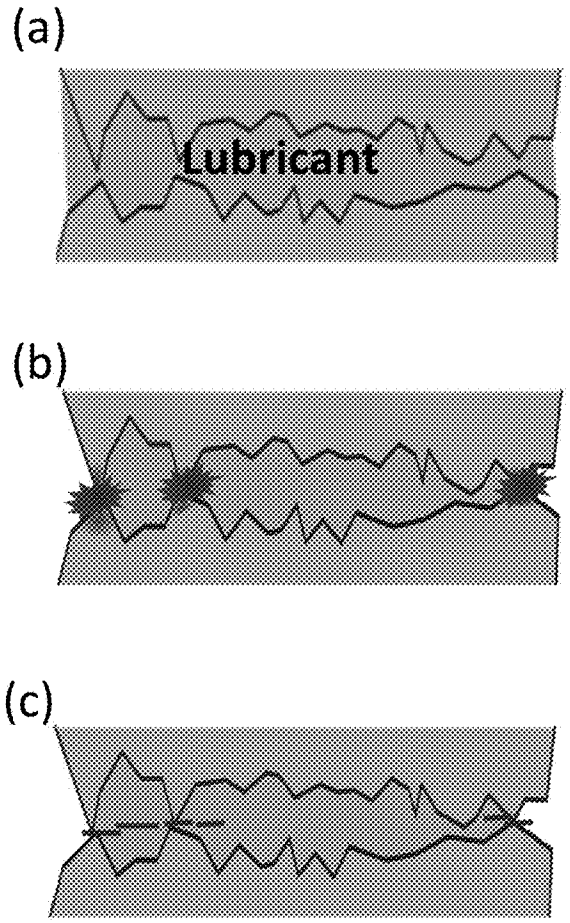
FIG. 1A, panels (a) through (c), is a schematic diagram illustrating tribofilm formation between two steel surfaces coated with a hydrocarbon fluid.

The catalytic activity of the steels comes from the chromium, molybdenum, or copper and nickel atoms that are incorporated into the steel alloys. These alloys are able to catalyze the formation of carbon-containing tribofilms from the hydrocarbon fluids present at the contact interface. A schematic diagram illustrating the tribofilm formation between two steel surfaces coated with a hydrocarbon fluid is shown in FIG. 1A, panels (a)-(c), and in the flow chart of FIG. 1B. Under boundary lubrication conditions, asperities on the surfaces of substrates come into contact (FIG. 1A, panel (a)). The resulting friction increases the temperature at the contact points, which induces the onset of catalysis (FIG. 1A, panel (b)). Without intending to be bound to any particular theory of the inventions, it is proposed that during the catalysis, chromium, molybdenum, copper, and/or nickel present in the steel alloy catalyze the fragmentation of the hydrocarbon molecules present at the sliding interface or a rolling interface and that these fragments react and reassemble into larger hydrocarbon molecules that form lubricious and wear-protective carbon-containing tribofilms (FIG. 1A, panel (c)). It should be noted that the tribofilm need not be a continuous film, but may be a discontinuous film comprising isolated, contacting, and/or overlapping solid deposits that are formed primarily or solely at the points of contact between the sliding and/or rolling surfaces. One or both of the substrates that are sliding against one another or that are in rolling contact may be composed of a chromium-containing steel, a molybdenum-containing steel, or a copper and nickel-containing steel of the types described herein, and the sliding or rolling substrates may be composed of the same steel of a type described herein or different types. For example, a first sliding or rolling substrate may be composed of a chromium-containing steel and a second sliding or rolling substrate may be composed of a copper and nickel-containing steel. In the sliding or rolling contacts, only one of the two substrates need be sliding or rolling. However, in some applications both substrates may be sliding and or one substrate may be sliding and the other substrate rolling.

The chromium molybdenum, copper and/or nickel of the steels may be, but need not be, distributed uniformly through the bulk of the steel substrate. For example, steels having a higher chromium, molybdenum, copper and/or nickel concentration toward the sliding or rolling surface can be used. However, advantageously, the chromium, molybdenum, copper, and/or nickel are incorporated as part of the steel alloy, rather than being part of a coating that is applied onto the steel substrate. This is advantageous because it allows for the continued ability of the steel alloy to catalyze the formation of the carbon-containing tribofilms without concern for the wearing-away of a coating.

The hydrocarbon fluids that are applied to the steel substrates include hydrocarbons and may consist only of hydrocarbons. Any liquid hydrocarbon may be used, but those having a viscosity lower than 5 cSt at 40° C. are preferred. For example, the hydrocarbons may be paraffins or polyolefins, such as polyalphaolefins. Polyalphaolefin (PAO) base oils that are made by polymerizing alpha-olefin molecules, such as ethylene, can be used. N-alkanes having a viscosity lower than 5 cSt at 40° C., such as dodecane, decane, and octane, are non-limiting examples. Viscosity can be measured as kinematic viscosity under ASTM D7042-04, as published in 2021. Because the steels are able to catalyze the formation of the carbon-containing tribofilms, the hydrocarbon fluids can be used with or without additives, such as additives that catalyze the formation of the carbon-containing tribofilms and/or that provide a carbon source for the formation of the tribofilms. For example, the hydrocarbon lubricants can be free of sulfur-containing (e.g., sulfates or sulfides), phosphorus-containing (e.g., phosphates), and/or chloride-containing additives, and/or other additives that are known as extreme pressure additives or antiwear additives. Phosphate-containing additives that may be excluded from the hydrocarbon coatings include zinc-containing and zinc-free compounds.

The carbon-containing tribofilms are characterized by the presence of D and G peaks in their Raman spectra. Such peaks are signatures of amorphous carbon materials containing a mixture of hydrogen, sp2-and sp3-bonded carbon, and sometimes other elements such as nitrogen and metals (e.g., DLC) and also of graphite. The D peak around 1350 $cm^{-1}$ is assigned to the breathing mode of-sp2 hybridized atoms in a carbon ring, while the G peak around 1580 $cm^{-1}$ corresponds to the stretching vibrations of the sp2 hybridized C in both chains and rings.

Example

This example illustrates the in situ formation of solid carbon-containing tribofilms at rubbing surfaces of high-carbon chromium-containing steels, high-carbon molybdenum-containing steels, and a low carbon content copper and nickel containing steel in the presence of liquid hydrocarbon containing films.

Figure 2:
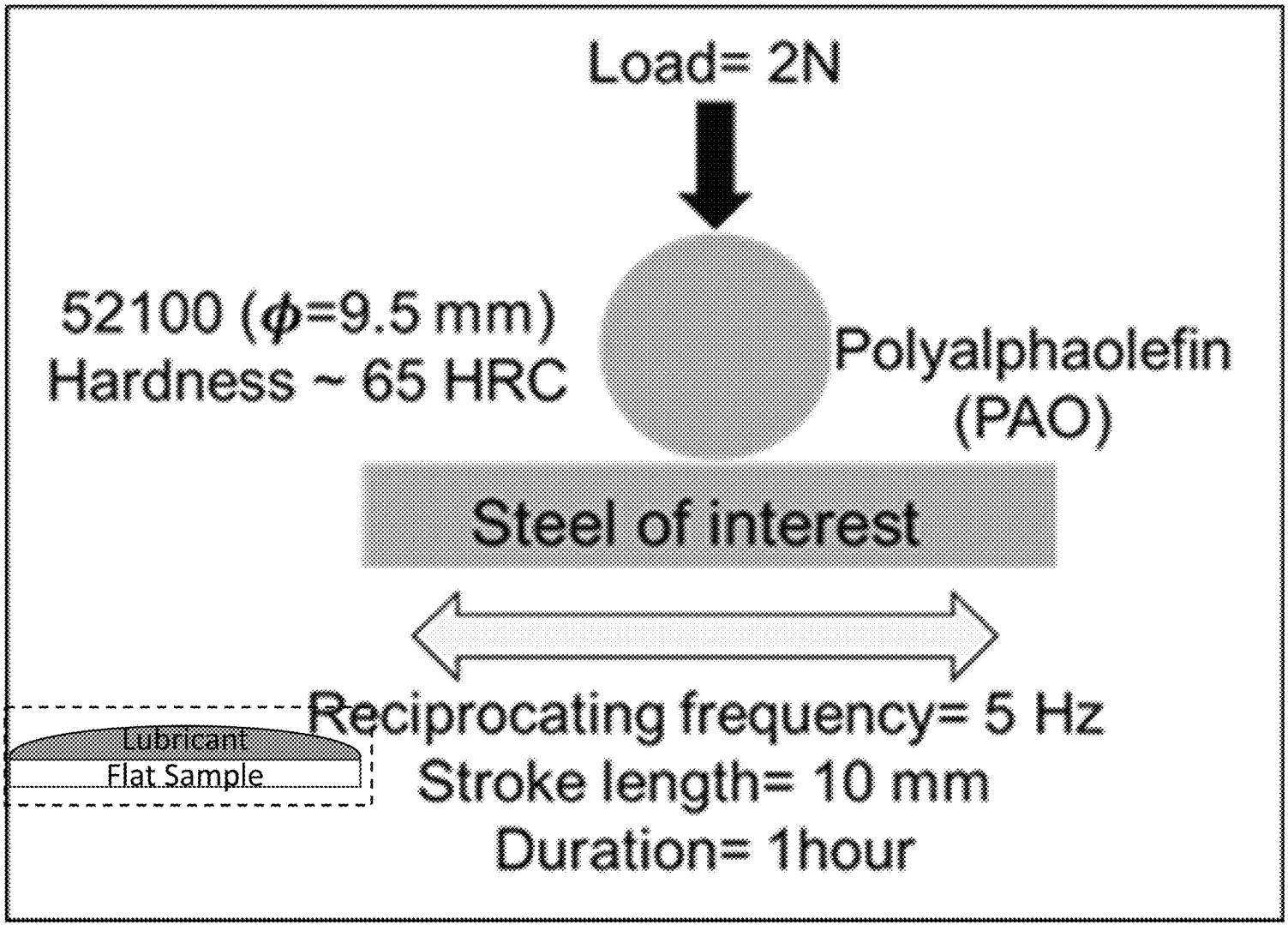
FIG. 2 is a schematic diagram showing an apparatus for friction testing.
Figure 3A:
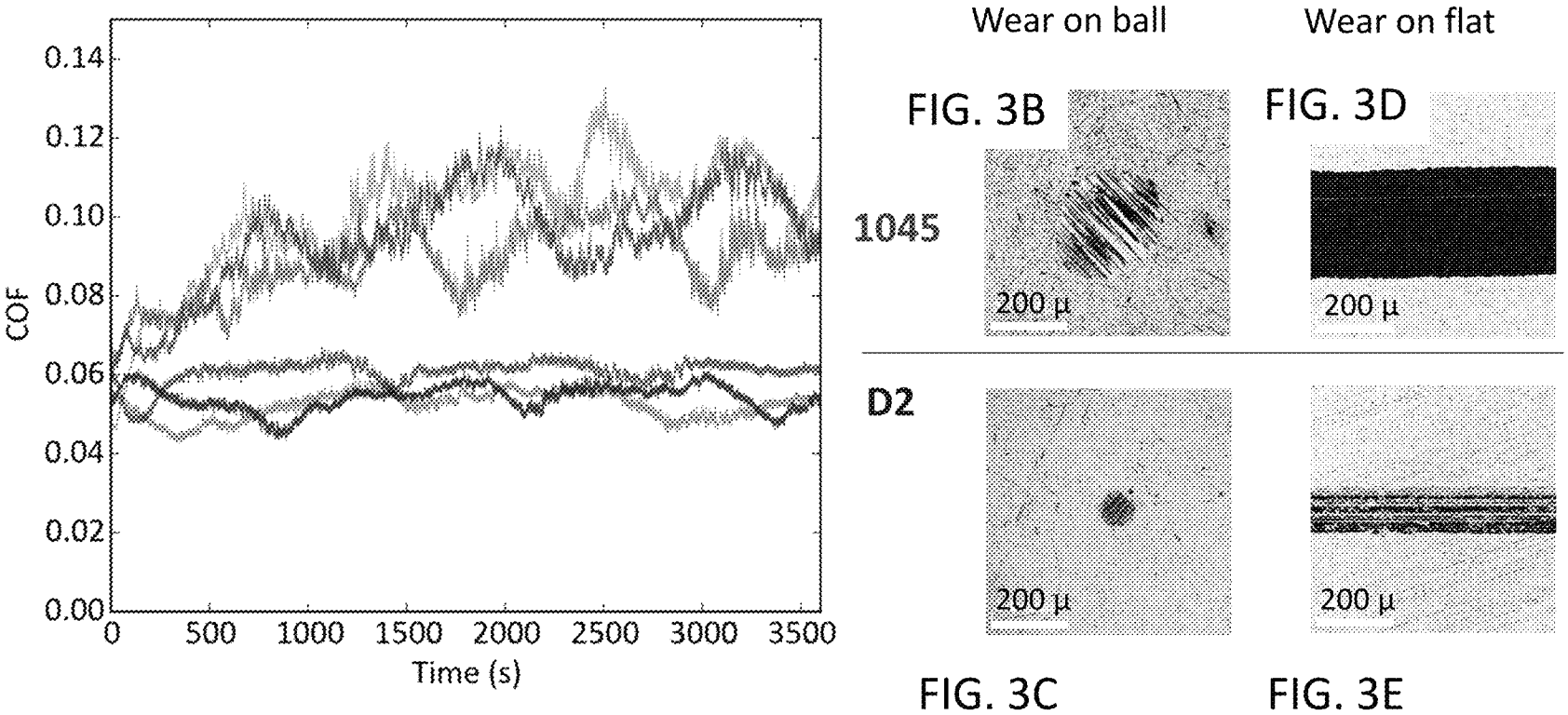
FIG. 3A is a friction comparison of D2 steel and 1045 steel.
Figure 3F:
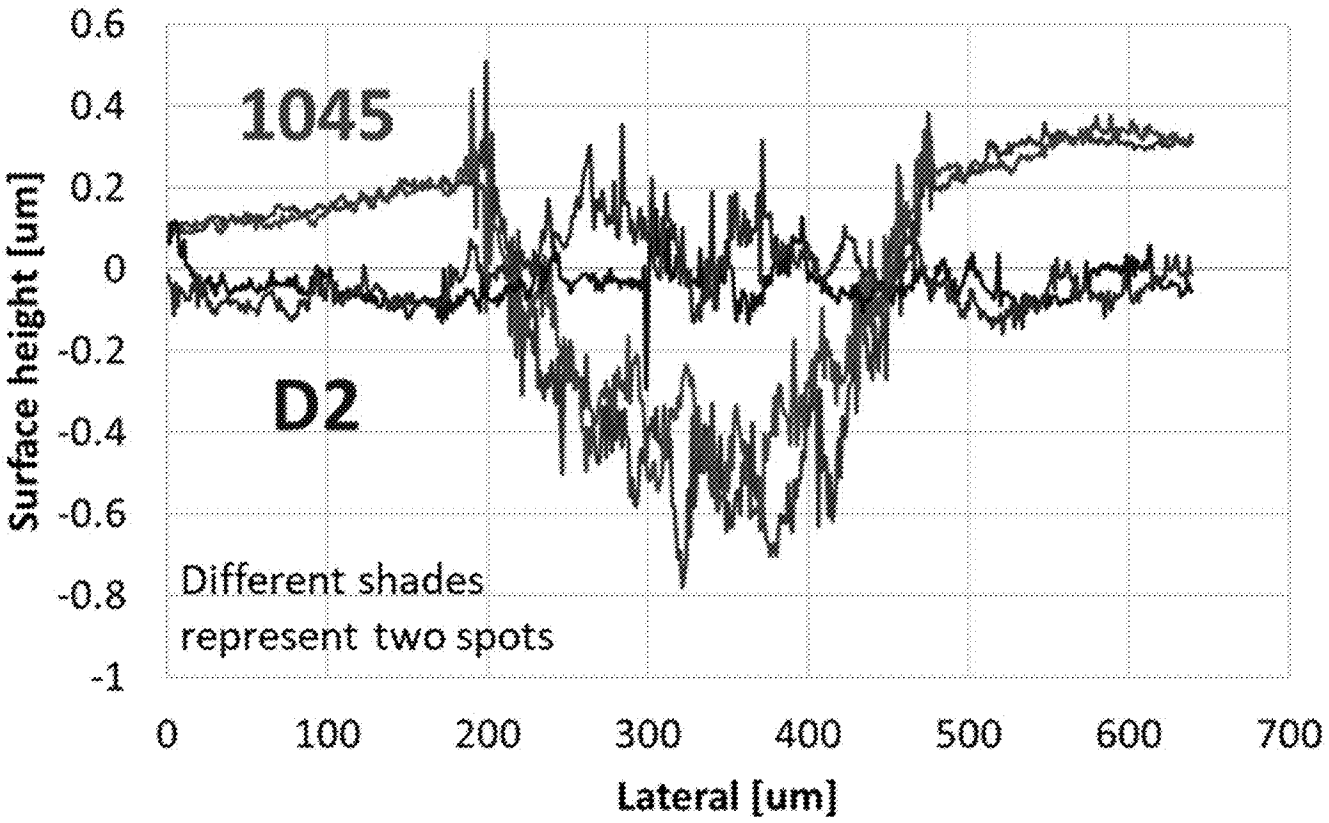
FIG. 3F shows surface profiles of the 1045 and D2 substrates after the friction tests.

FIG. 2 shows the friction test setup used in the testing of D2, A2, and M2 steel substrates and on 1045 steel. The setup included a ball (52100 steel) rubbing on a flat substrate specimen (i.e., the steel of interest). The setup resulted in boundary lubrication conditions during the tribo-testing. The contact was lubricated with a PAO 4 oil, as shown in FIG. 2, inset. The solid deposits left near the ball wear scar after the friction tests were characterized by RAMAN spectroscopy.

Chromium-Containing Steels. Friction testing was conducted on D2, a steel containing 11-12 wt. % Cr and 1045, a steel with no Cr content (Table 2). The comparison was conducted between 1045 and D2 steel to demonstrate the catalytic activity of chromium. Prior to testing, both steels were heat-treated to give the same Vickers hardness (~230). A 9.5 mm diameter ball made from 52100 steel and having a smooth surface (Ra roughness ~5 nm) was loaded against a flat steel sample (Ra roughness ~20 nm) and the interface was lubricated by polyalphaolefin (PAO), a hydrocarbon base oil, without additives. Reciprocating tests were conducted under normal load of 2N, a frequency of 5 Hz, and stroke length of 10 mm. During the motion, the lateral forces experienced by the ball were recorded with time and coefficient of friction data were obtained. After the friction test, the ball and substrate were rinsed with hexane and examined under a 3D laser confocal microscope to assess surface wear. The results show drastic improvements in friction and wear resistance for the D2 steel substrate (FIGS. 3A-3F).

Figure 4A:
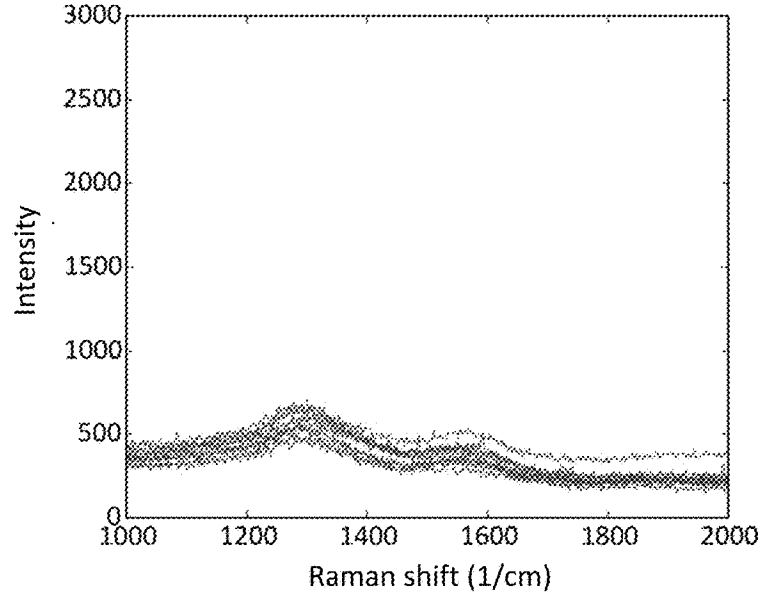
FIGS. 4A-4C show Raman spectra of wear deposits obtained from the surfaces of (FIG. 4A) 1045 steel, and (FIG. 4B) from D2 steel substrates after friction testing.
Figure 4B:
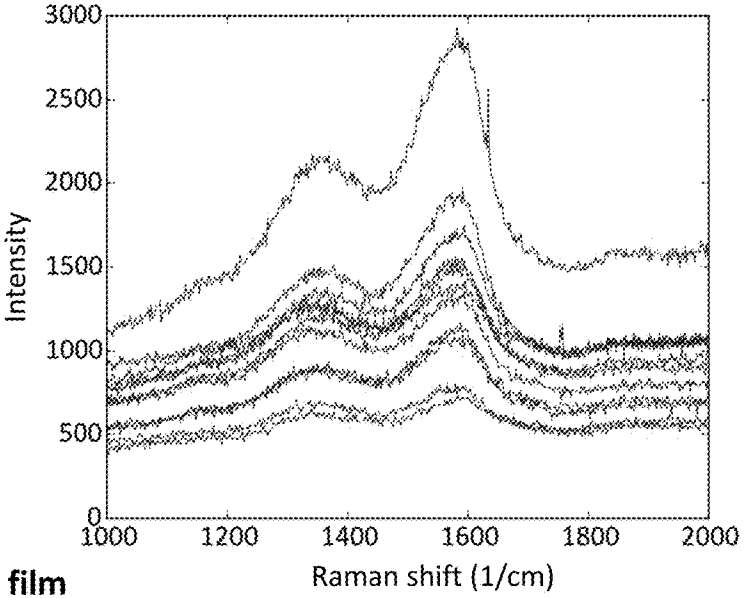
Figure 4C:
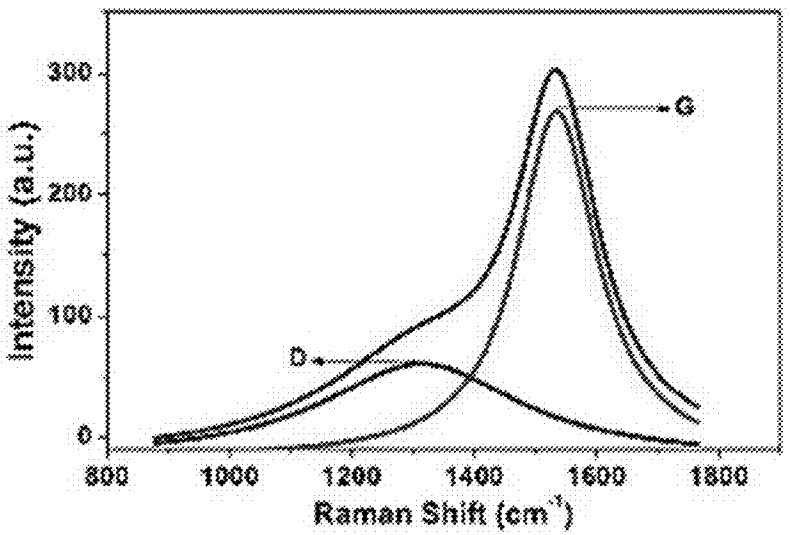
Figure 5A:
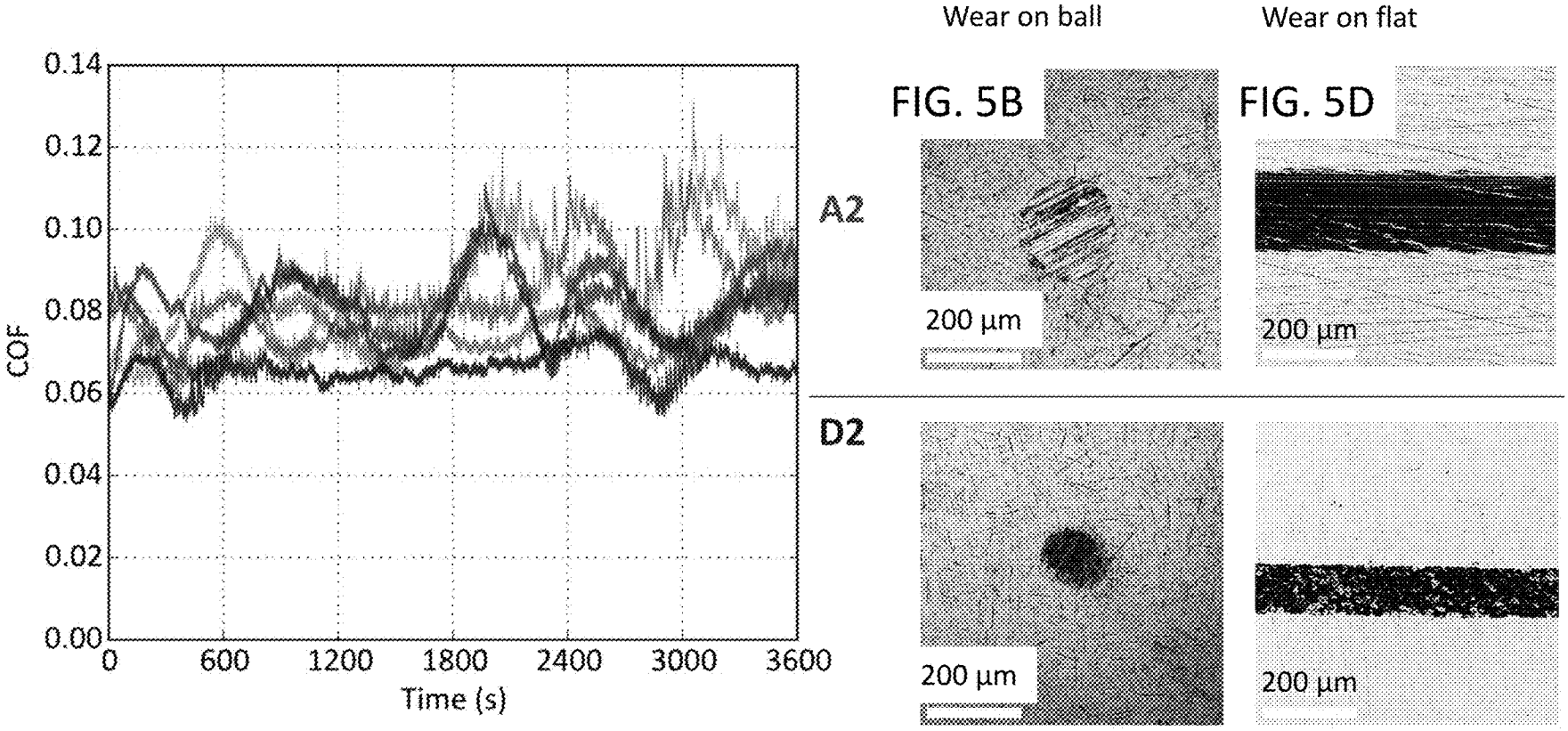
FIG. 5A is a friction comparison of A2 steel and D2 steel.
Figure 5F:
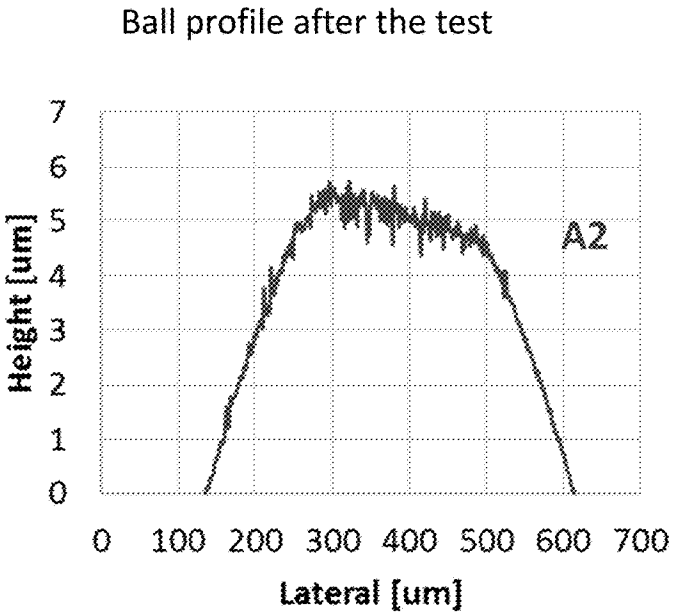
FIG. 5F shows the ball surface profile after the A2 steel friction test.
Figure 5G:
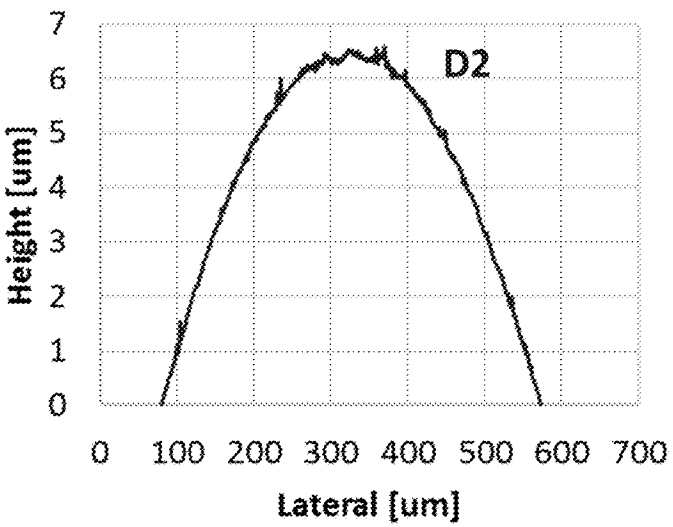
FIG. 5G shows the ball surface profile after the D2 steel friction test.

A dark-colored solid deposit that had accumulated on the ball surface at the end of tribo-testing was rinsed with hexane to remove the residual lubricant. Raman spectroscopy (Horiba LabRam HR Evolution Confocal Raman microscope) was used to study the deposit using laser wavelength of 473 nm. The Raman spectra for the wear deposit on the 1045 steel, the wear deposit on the D2 steel, and a DLC film are shown in FIGS. 4A-4C. D2 exhibits the D and G band signatures that are characteristic of carbon-containing tribofilms (such as diamond-like carbon), confirming formation of carbon films. Carbon tribofilm formation on the D2 steel surface explains its better tribological performance. In contrast, the solid deposit obtained from the surface of the 1045 steel shows features characteristic of oxide debris. These results demonstrate that the presence of Cr in the D2 steel plays a catalytic role in the formation of beneficial carbon-containing tribofilms during sliding or rolling in the presence of a hydrocarbon fluid.

TABLE 2

Copper, molybdenum, chromium, and vanadium content of 52100, D2, and 1045 steels.

| | Cu | Mo | Cr | V |
|---|---|---|---|---|
| 52100 | 0 | 0 | 1.3-1.6 | 0 |
| D2 | 0 | 0.5-0.7 | 11-12.1 | 0.1-0.5 |
| 1045 | 0 | 0 | 0 | 0 |

To further confirm the catalytic activity of chromium on in situ tribofilm formation, an additional comparative friction test was conducted between A2 steel and D2 steel, which has a lower chromium content than A2 steel (Table 3).

TABLE 3

Copper, molybdenum, chromium, and vanadium content of the 52100, A2, and D2 steels.

| | Cu | Mo | Cr | V |
|---|---|---|---|---|
| 52100 | 0 | 0 | 1.3-1.6 | 0 |
| A2 | 0 | 1 | 5 | 0.15-0.5 |
| D2 | 0 | 0.5-0.7 | 11-12.1 | 0.1-0.5 |

Figure 6A:
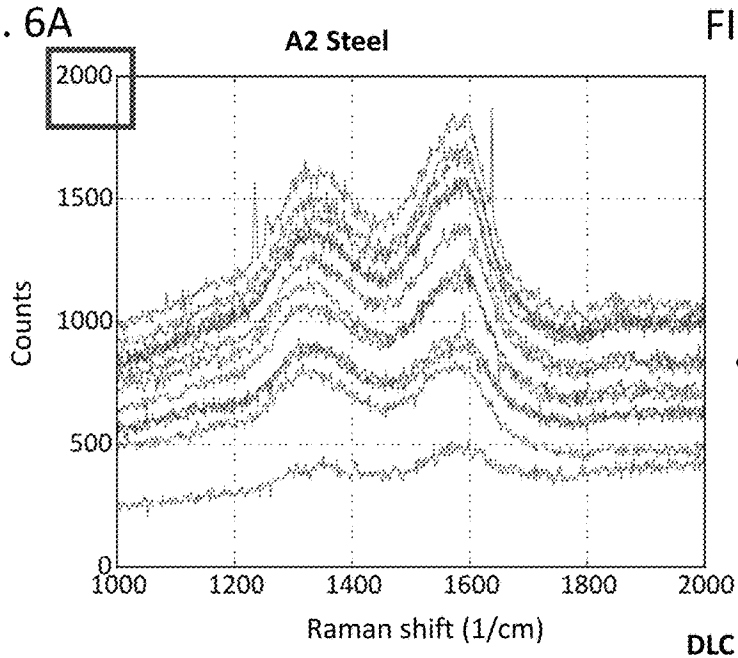
FIGS. 6A-6C show Raman spectra of wear deposits obtained from the surfaces of (FIG. 6A) A2 steel, and (FIG. 6B) from D2 steel substrates after friction testing.
Figure 6B:
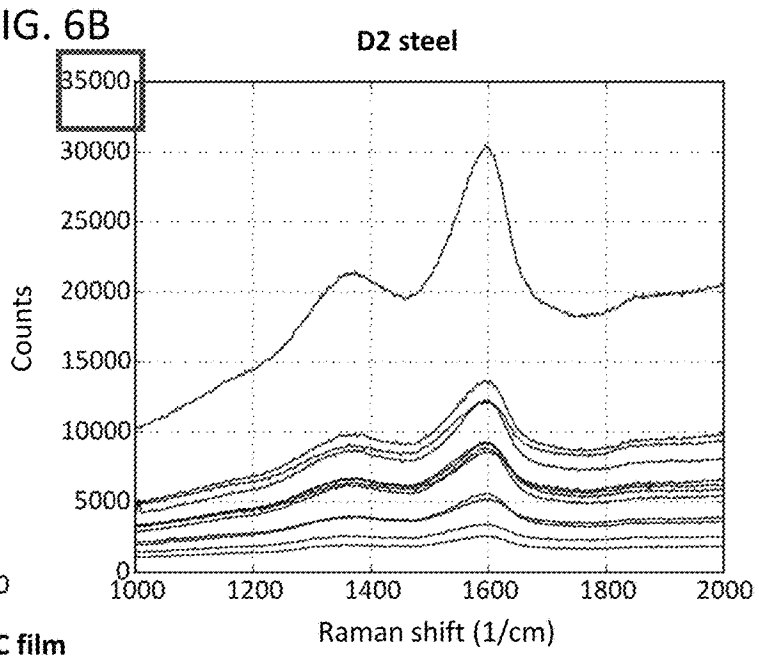
Figure 6C:
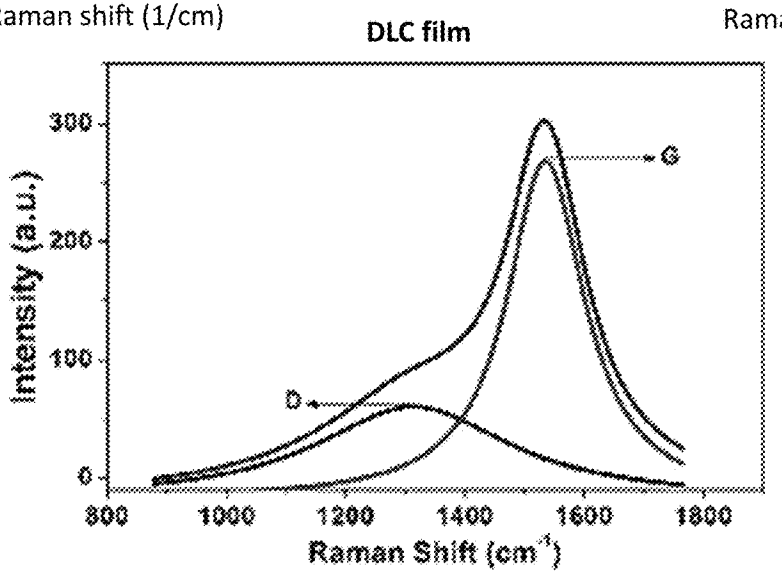

Friction and wear performance of D2 is better than A2, as determined by lower coefficient of friction (COF) and less surface wear (FIGS. 5A-5G). Both alloys were heat-treated to give the same Vickers hardness (~360). The Raman spectra for the solid wear deposits obtained from the A2 and D2 steels and for a DLC film are shown in FIGS. 6A-6C. Both D2 and A2 showed formation of carbon-containing tribofilms, the intensities of the D and G peaks for D2 being much higher. These results further demonstrate that chromium in the steel alloy of the substrate plays a catalytic role in the formation of carbon-containing tribofilms in the presence of hydrocarbon molecules, even in the absence of antiwear and extreme pressure additives.

Figure 7F:
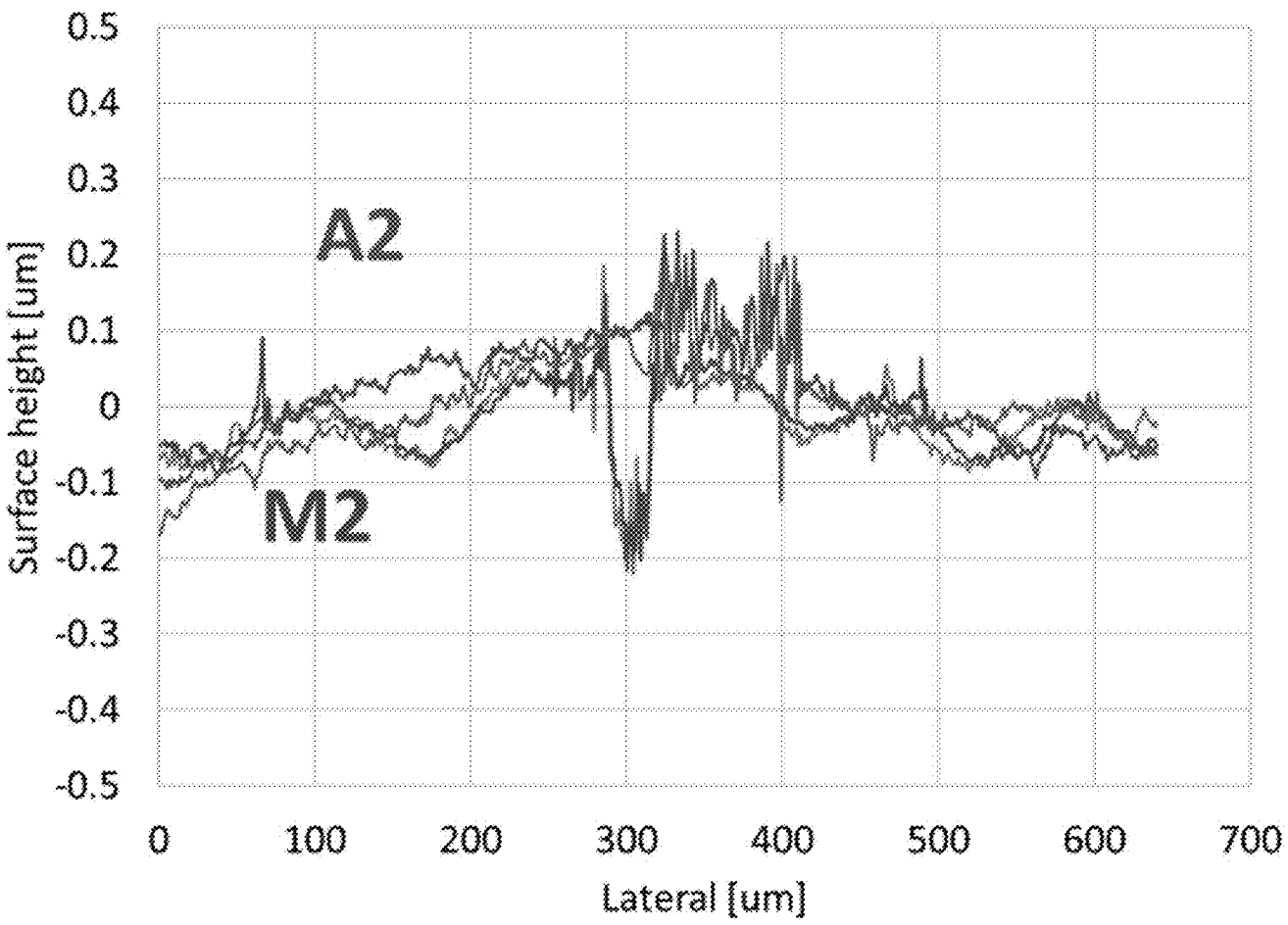
FIG. 7F shows the surface profiles of the A2 steel and M2 steel substrates after the friction tests.

Molybdenum-Containing Steel. Comparative friction testing was conducted between A2 steel and M2 steel (FIG. 7A). M2 steel has a higher molybdenum content than A2 steel (Table 4) and was used to demonstrate the catalytic activity of molybdenum on in situ carbon-containing tribofilm formation.

TABLE 4

Copper, molybdenum, chromium, and vanadium content of the 52100, A2, and M2 steels.

| | Cu | Mo | Cr | V |
|---|---|---|---|---|
| 52100 | 0 | 0 | 1.3-1.6 | 0 |
| A2 | 0 | 1 | 5 | 0.15-0.5 |
| M2 | 0 | 4.5-5.5 | 3.75-4.5 | 1.75-2.2 |

Similar strength of A2 and M2 (~290 Vickers)

Figure 8A:
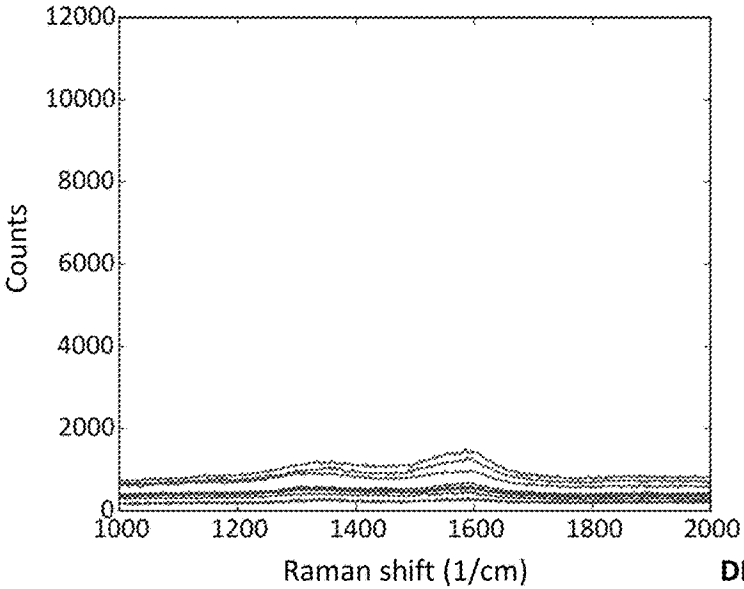
FIGS. 8A-8C show Raman spectra of wear deposits obtained from the surfaces of (FIG. 8A) M2 steel, and (FIG. 8B) from A2 steel substrates after friction testing.
Figure 8B:
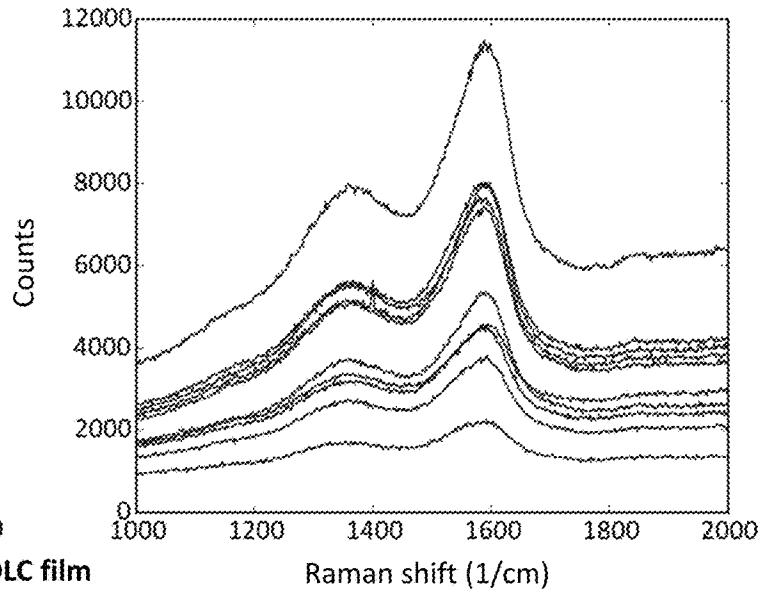
Figure 8C:
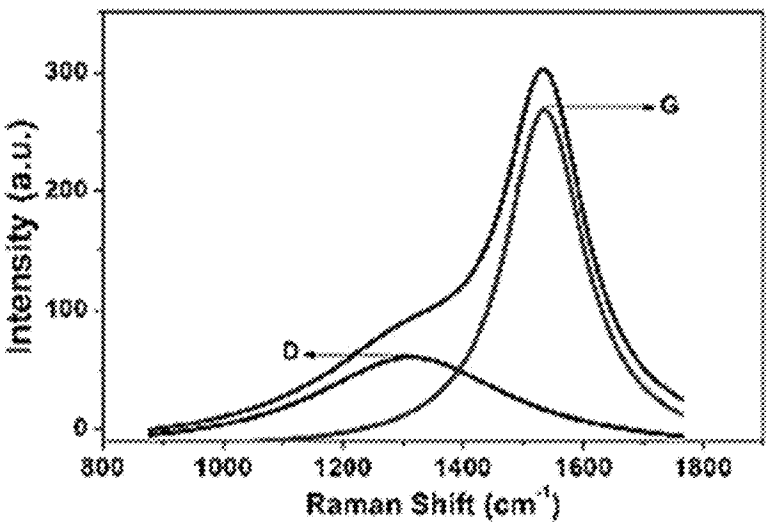

Both A2 and M2 were heat-treated to give the same Vickers hardness (~290). While friction performance, as determined by COF (FIG. 7A), was not too different for the A2 and M2 steels, M2 showed higher wear (FIGS. 7B-7F). The Raman spectra for the wear deposits obtained from the M2 and A2 steels and for a DLC film are shown in FIGS. 8A-8C. Both the M2 and A2 surfaces showed formation of carbon-containing tribofilms, the intensity of the D and G peaks for the deposit from the A2 steel being much higher due to the combined effect of Cr and Mo. It should be noted, however, that singling out the effects of molybdenum from those of chromium is a challenge, as both M2 and A2 have a considerable amount of chromium in them.

Additional testing of the tribofilm-forming properties of D2 steel and CF2 steel coated with the representative hydrocarbon dodecane was conducted. The steels were hardened and polished to a comparable Vickers Hardness, as shown in Table 5.

TABLE 5

| aterial | Austenization | Quench | Tempering | Vickers Hardness (HV0.3) |
|---|---|---|---|---|
| 52100 | 845° C. for 1 hour | Oil quench | 550° C. for 1 hour | 383 ± 5 |
| D2 | 1000° C. for 1 hour | Air quench to 65° C. | 650° C. for 4 hours | 339 ± 7 |
| CF2 | 900° C. for 1 hour | Water quench | 500° C. for 1 hour | 397 ± 8 |

Figure 9A:
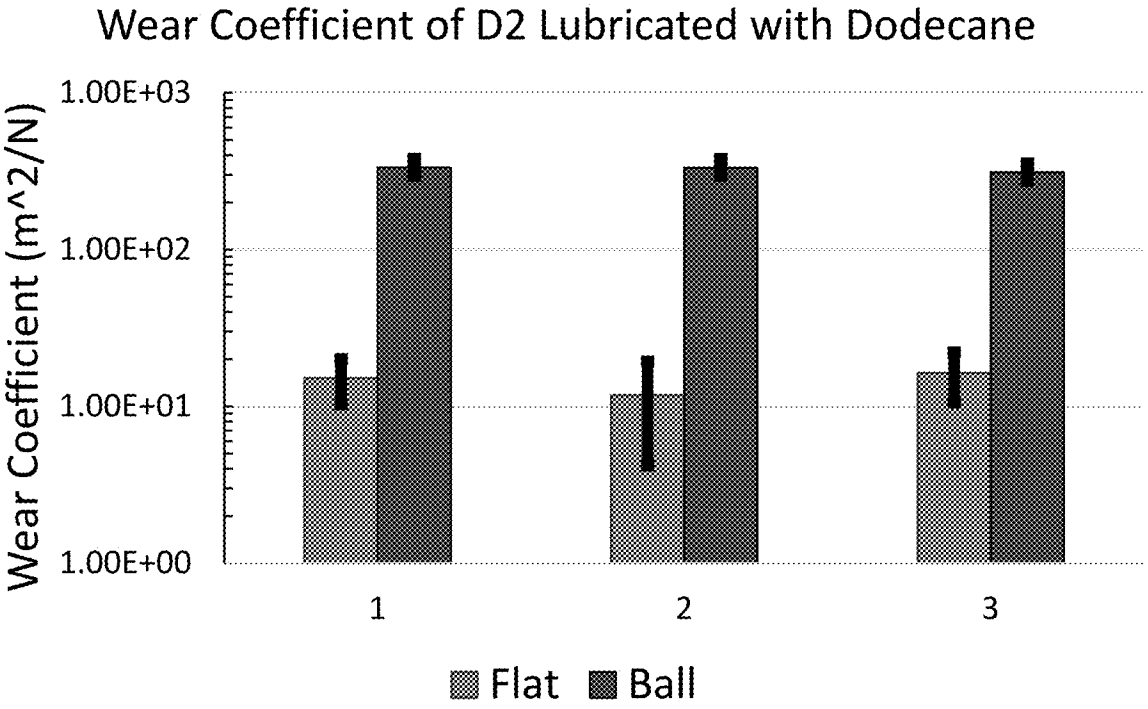
FIG. 9A shows the wear coefficients for three studies of a D2 substrate lubricated with dodecane.
Figure 9B:
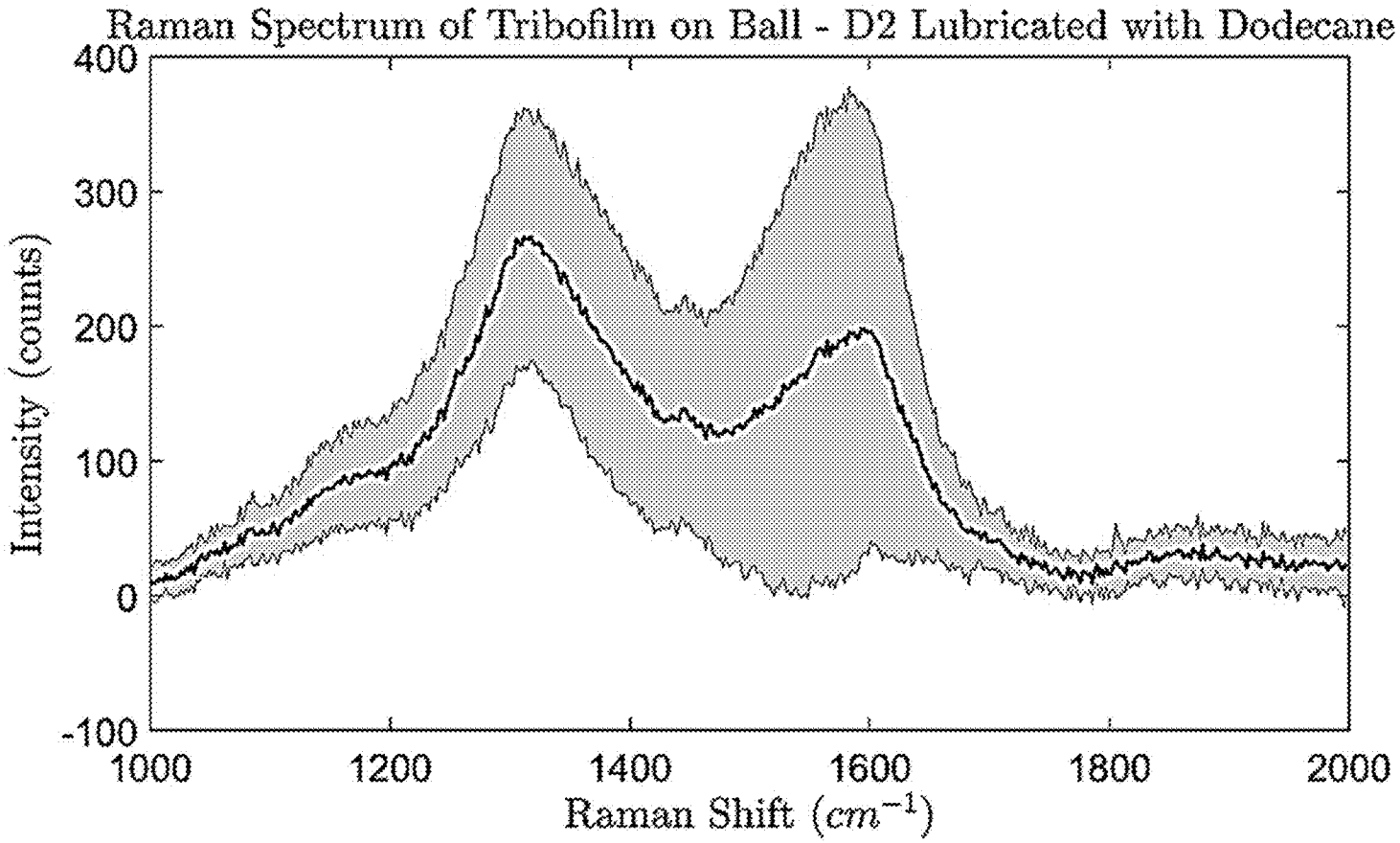
FIG. 9B shows the average Raman spectrum of 13 one square micron spots taken from the tribofilm accumulated on the ball during the test of the D2 substrate.

The wear coefficients for three trials with the D2 substrate lubricated with dodecane are shown in FIG. 9A. Over the three tests, the wear coefficients for the D2 Flat were $1.44\times10^{-16}\pm3.57\times10^{-17}$ $m^2/N$. The wear coefficients for the 52100 ball were $3.26\times10^{-15}\pm1.88\times10^{13}$ $m^2/N$. FIG. 9B shows the average Raman spectrum of 13 one square micron spots taken from the tribofilm accumulated on the ball during the test. The D and G peaks near wavenumbers 1350 and 1600, characteristic of carbon films, were present.

Figure 10:
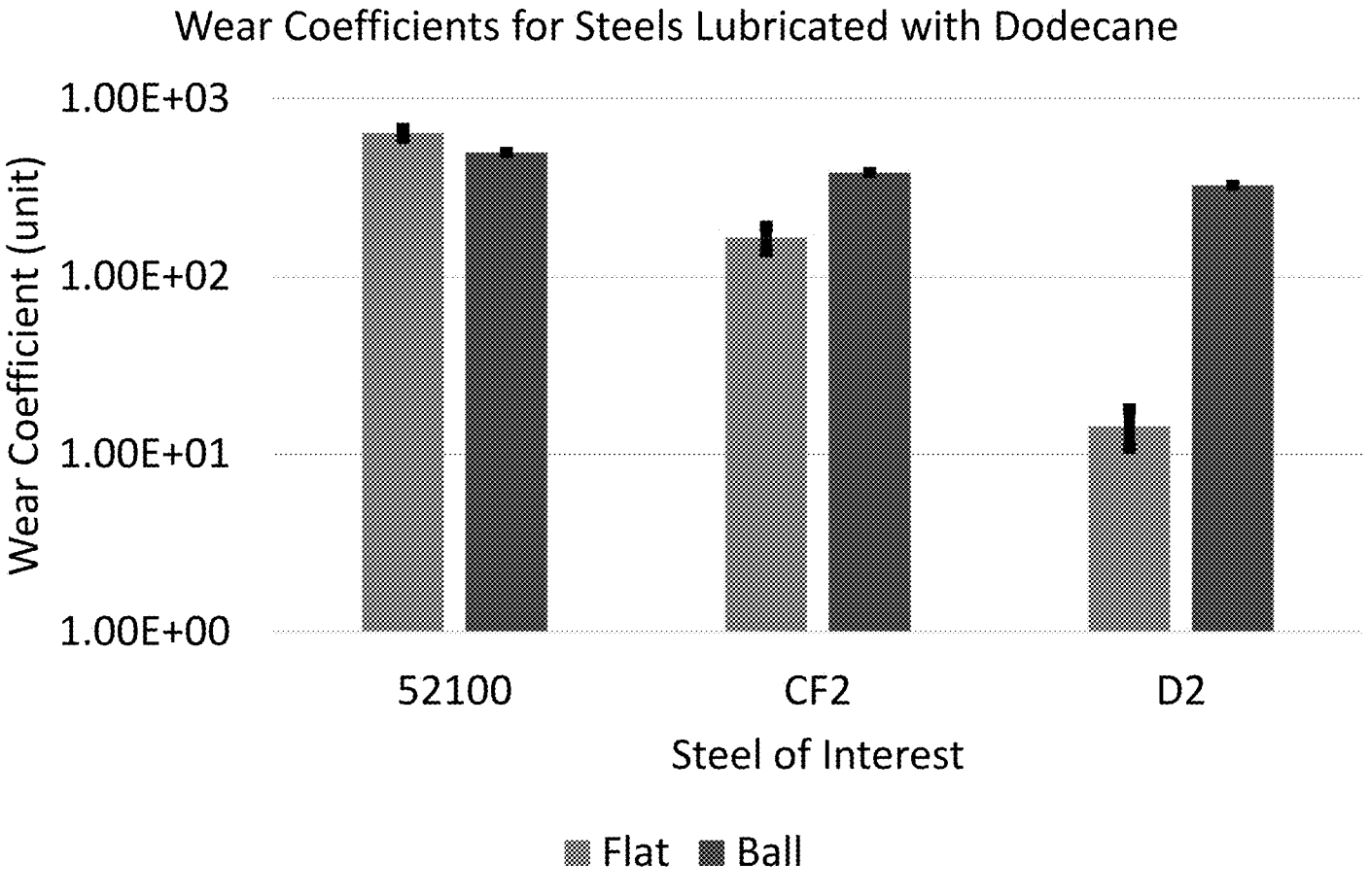
FIG. 10 shows the wear coefficients for three studies of a CF2 substrate lubricated with dodecane.

The wear coefficients for three trials with the CF2 substrate lubricated with dodecane are shown in FIG. 10, the results for the 52100 ball, a flat 52100 substrate, and a D2 substrate are also shown. The wear coefficients for the CF2 Flat were $1.65\times10^{-15}\pm2.67\times10^{-16}$ $m^2/N$. The wear coefficients for the 52100 ball were $3.84\times10^{-15}\pm9.17\times10^{-24}$ $m^2/N$.

Figure 11:
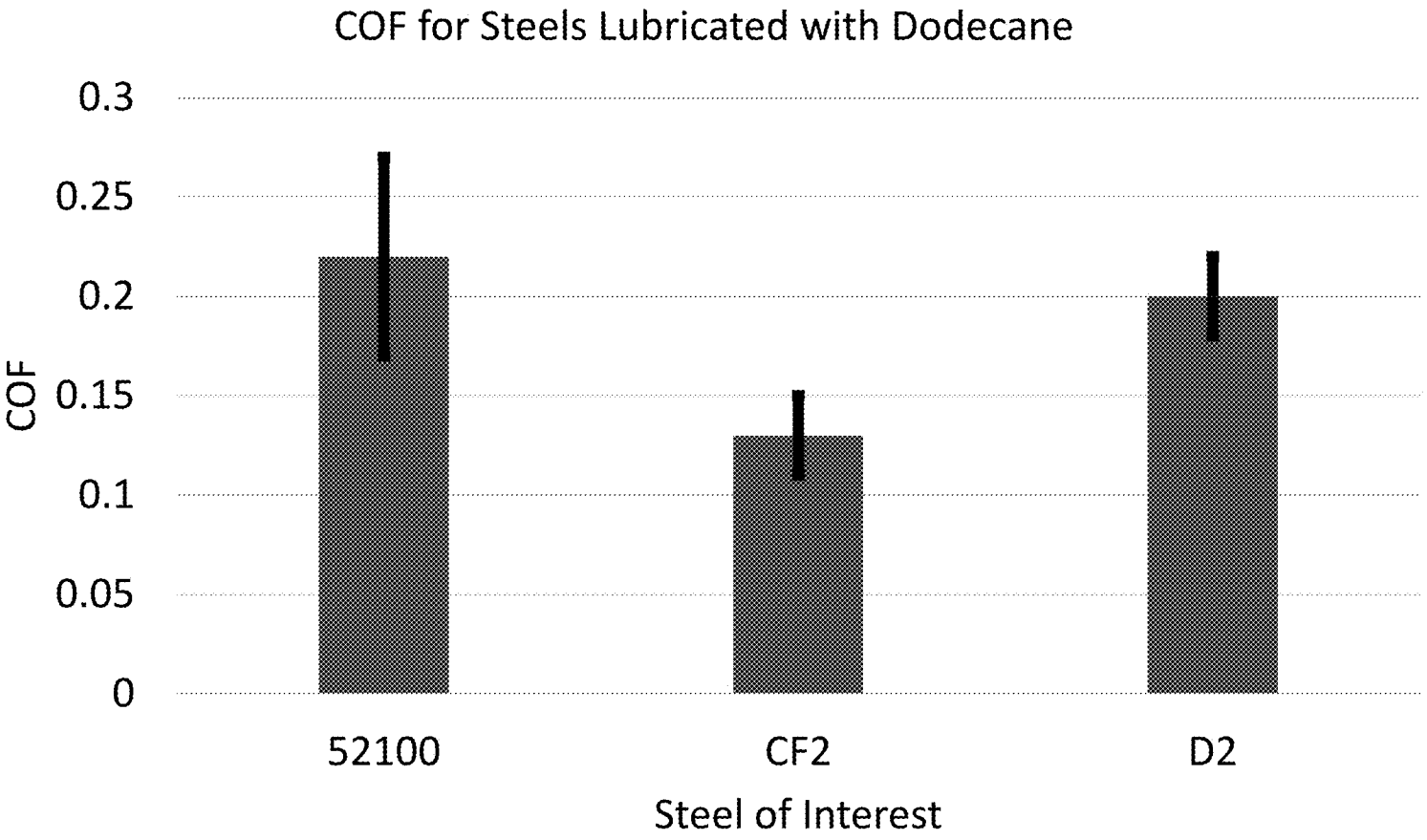
FIG. 11 shows the coefficients of friction (COFs) for a 52100 substrate, a CF2 substrate, and a D2 substrate, each lubricated with dodecane.

The coefficients of friction (COFs) for the 52100 substrate, the CF2 substrate, and the D2 substrate, each lubricated with dodecane, are shown in FIG. 11. The COF values were as follows: 52100:0.22±0.05; CF2:0.13±0.02; and D2:0.20±0.02.

Figure 12:
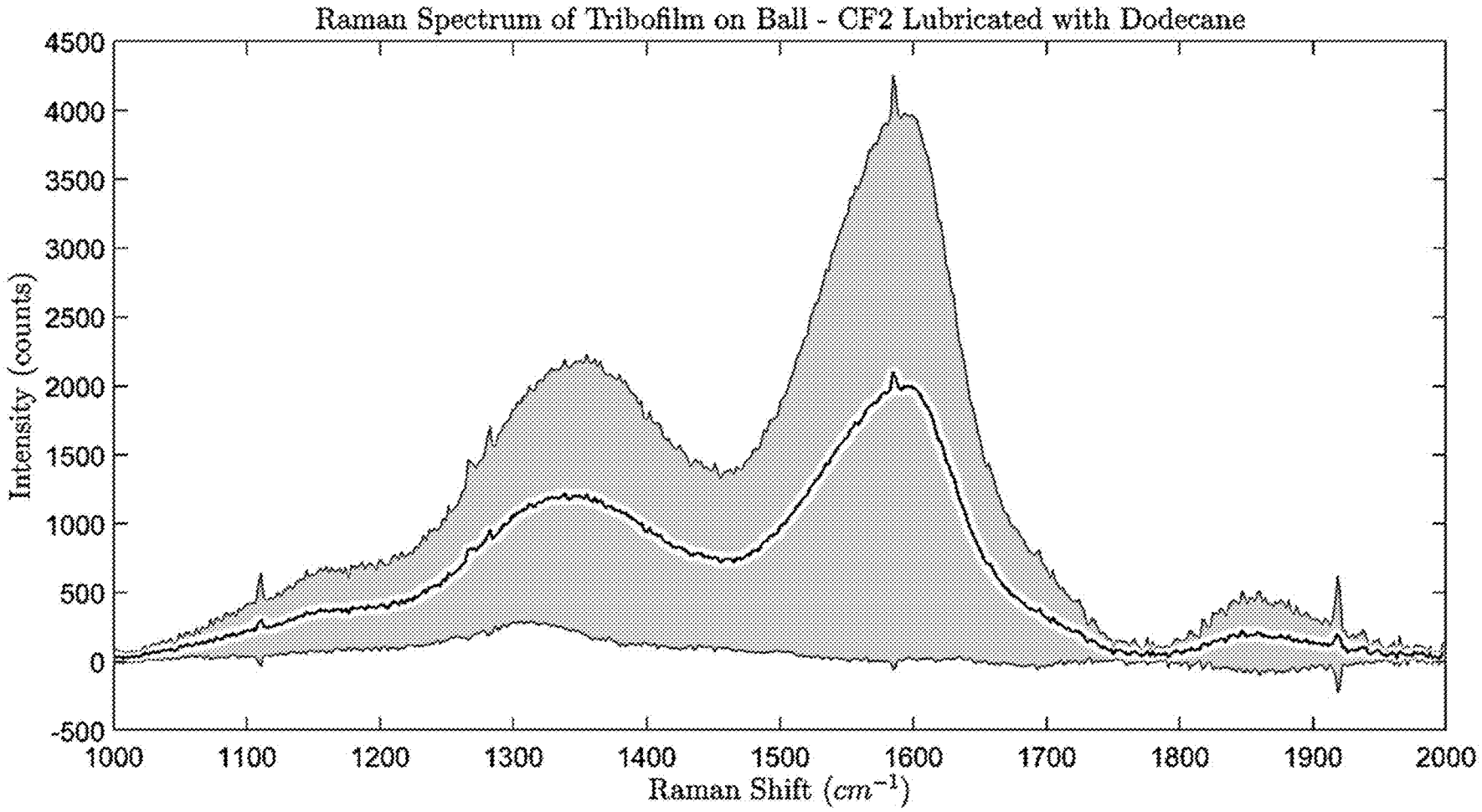
FIG. 12 shows the average Raman spectrum of 13 one square micron spots taken from a tribofilm accumulated on a ball during tests of a CF2 substrate. D and G peaks near wavenumbers 1350 and 1600, characteristic of carbon films, were present.

FIG. 12 shows the average Raman spectrum of 13 one square micron spots taken from the tribofilm accumulated on the ball during the tests of the CF2 substrate. The D and G peaks near wavenumbers 1350 and 1600, characteristic of carbon films, were present.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure "a" or "an" can mean "one or more" and can also mean "only one". Embodiments of the inventions described herein consistent with either construction are covered.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A method of forming a lubricious and wear-protective film on sliding or rolling steel surfaces, the method comprising:

providing a first steel substrate, wherein the first steel substrate is a high-carbon steel having a chromium content in the range from 5 weight percent to 15 weight percent, a high-carbon steel having a molybdenum content in the range from 0.2 weight percent to 2 weight percent; or a low-carbon steel having a combined copper and nickel content of at least 1 weight percent;

applying a coating comprising a hydrocarbon fluid onto a surface of the first steel substrate; and sliding the hydrocarbon fluid-coated substrate surface against, or rolling the hydrocarbon fluid-coated substrate over, a second steel substrate, wherein the chromium, molybdenum, copper, or nickel in the first steel substrate catalyzes the formation of a solid carbon-containing tribofilm from the hydrocarbon fluid.

2. The method of claim 1, wherein the hydrocarbon fluid is free of additives that provide a carbon source for the formation of the carbon-containing tribofilm and free of additives that react with the first or second steel substrates to form the carbon-containing tribofilm.

3. The method of claim 1, wherein the hydrocarbon fluid consists of only one or more hydrocarbons.

4. The method of claim 1, wherein the first steel substrate comprises at least 10 weight percent chromium.

5. The method of claim 1, wherein the first steel substrate has a chromium content in the range from 10 weight percent to 15 weight percent.

6. The method of claim 1, wherein the first steel substrate is a D2 steel substrate.

7. The method of claim 1, wherein the first steel substrate is an A2 steel substrate.

8. The method of claim 1, wherein the first steel substrate comprises at least 2 weight percent copper and 2 weight percent nickel.

9. The method of claim 1, wherein the first steel substrate has a copper content in the range from 1 weight percent to 5 weight percent and a nickel content in the range from 1 weight percent to 5 weight percent.

10. The method of claim 1, wherein the first steel substrate is a CF2 steel substrate.

11. The method of claim 1, wherein the first and second steel substrates are composed of the same steel.

12. The method of claim 1, wherein the first steel substrate is an engine part or a transmission part.

13. The method of claim 12, wherein the first steel substrate is a valve part, a pump part, a cam, a tappet, a shaft, or a gear.

14. The method of claim 13, wherein the first steel substrate is a D2 substrate.

15. The method of claim 14, wherein the hydrocarbon fluid is free of additives that provide a carbon source for the formation of the carbon-containing tribofilm and free of additives that react with the first or second steel substrates to form the carbon-containing tribofilm.

16. The method of claim 13, wherein the first steel substrate is an A2 substrate.

17. The method of claim 16, wherein the hydrocarbon fluid is free of additives that provide a carbon source for the formation of the carbon-containing tribofilm and free of additives that react with the first or second steel substrates to form the carbon-containing tribofilm.

18. The method of claim 13, wherein the first steel substrate is a CF2 substrate.

19. The method of claim 18, wherein the hydrocarbon fluid is free of additives that provide a carbon source for the formation of the carbon-containing tribofilm and free of additives that react with the first or second steel substrates to form the carbon-containing tribofilm.

20. The method of claim 1, wherein the first steel substrate has a molybdenum content in the range from 0.2 weight percent to 2 weight percent and further comprises at least one of chromium, copper, and nickel at a concentration of at least 0.3 weight percent.

21. The method of claim 1, wherein the hydrocarbon fluid is a polyalphaolefin having a viscosity of less than 5 cSt at 40° C.

* * * * *